US009074387B2

(12) United States Patent
Camp, Jr.

(10) Patent No.: US 9,074,387 B2
(45) Date of Patent: Jul. 7, 2015

(54) PORTABLE TOMBSTONE

(71) Applicant: William P. Camp, Jr., Vanlue, OH (US)

(72) Inventor: William P. Camp, Jr., Vanlue, OH (US)

( * ) Notice: Subject to any disclaimer, the term of this patent is extended or adjusted under 35 U.S.C. 154(b) by 0 days.

(21) Appl. No.: 14/211,512

(22) Filed: Mar. 14, 2014

(65) Prior Publication Data

US 2014/0259983 A1 Sep. 18, 2014

Related U.S. Application Data

(60) Provisional application No. 61/788,203, filed on Mar. 15, 2013.

(51) Int. Cl.
*E04H 13/00* (2006.01)

(52) U.S. Cl.
CPC ..... *E04H 13/003* (2013.01)

(58) Field of Classification Search
CPC ..... E04H 13/00; E04H 13/003; E04H 13/008; G01C 15/04
USPC ..... 52/1–3, 104, 128, 136, 103; 47/41.01, 47/41.1, 66.6 X, 39, 65.5; 40/124.5, 559; 27/1
See application file for complete search history.

(56) References Cited

U.S. PATENT DOCUMENTS 1,982,432 A * 11/1934 Hull ..... 47/79
2,075,859 A * 4/1937 Martin ..... 52/38
4,185,425 A 1/1980 Merkel
4,463,527 A * 8/1984 Schlosser ..... 52/103
4,697,316 A * 10/1987 Semon ..... 27/1
5,014,472 A * 5/1991 Svensson ..... 52/103
5,363,609 A 11/1994 Hancovsky
5,517,790 A * 5/1996 Jennings ..... 52/103
5,517,791 A 5/1996 Weiss
5,595,029 A * 1/1997 Revoir et al. ..... 52/103
5,732,515 A * 3/1998 Rodrigues et al. ..... 52/103
5,875,529 A * 3/1999 Ollier ..... 27/6
6,279,212 B1 * 8/2001 Balch ..... 27/1
6,338,211 B1 1/2002 Carney
6,463,703 B1 * 10/2002 Mattis ..... 52/103
6,769,213 B1 * 8/2004 Cardarelli ..... 47/80
6,904,721 B1 * 6/2005 Forbes ..... 52/103
8,286,314 B1 * 10/2012 Muthusami ..... 27/1
8,429,859 B2 4/2013 Dickinson et al.

(Continued)

FOREIGN PATENT DOCUMENTS

WO 2010146274 A1 12/2010

OTHER PUBLICATIONS http://www.wholesalepartystore/store/p/50045-Plastic-Tombstone-24-Each.html?feed=Froogle, printed on Jun. 17, 2014.

(Continued)

*Primary Examiner* — Beth Stephan
(74) *Attorney, Agent, or Firm* — Fraser Clemens Martin & Miller LLC; Jacob M. Ward, Esq.

(57) ABSTRACT

A portable tombstone includes a main body having a first cavity and a second cavity. The first cavity is defined by an interior surface of the main body, and is filled with a weighting media to improve stability. The second cavity is defined by an exterior surface of the main body, and holds a capsule configured to contain ashes or mementos. The first cavity and the capsule are sealingly enclosed with a plug and a cap, respectively. The portable tombstone is molded from a polymeric material having a stone-like appearance.

15 Claims, 3 Drawing Sheets

(56) References Cited

U.S. PATENT DOCUMENTS

| | | | | |
|---|---|---|---|---|
| 8,555,561 | B2 | 10/2013 | Dickinson et al. | |
| 2003/0037492 | A1 | 2/2003 | Rodrigues | |
| 2003/0167706 | A1* | 9/2003 | Pazar | 52/128 |
| 2007/0079535 | A1 | 4/2007 | Newton | |
| 2008/0229679 | A1* | 9/2008 | Trail | 52/103 |
| 2011/0010916 | A1 | 1/2011 | Weder | |
| 2013/0031849 | A1 | 2/2013 | Dickinson et al. | |
| 2013/0031850 | A1 | 2/2013 | Dickinson et al. | |
| 2013/0061540 | A1 | 3/2013 | Denney | |
| 2013/0210329 | A1 | 8/2013 | God et al. | |
| 2013/0280011 | A1 | 10/2013 | Burd | |
| 2013/0305502 | A1 | 11/2013 | Weder | |

OTHER PUBLICATIONS http://www.ebay.com/bhp/tombstone-mold, printed on Jun. 17, 2014.

http://www.alibaba.com/showroom/plastic-tombstone.html, printed on Jun. 17, 2014.

http://www.laserengraving4u.com/headstonephoto.html, printed on Jun. 17, 2014.

http://www.undereverystone.blogspot.com/2012/05/i-am-glad-it-as-me-instead-of-you-mayor.html, printed on Jun. 17, 2014.

http://www.inlovingmemoryofpets.com/PetMemorialUrns.html, printed on Jun. 17, 2014.

* cited by examiner

PORTABLE TOMBSTONE

CROSS-REFERENCE TO RELATED APPLICATIONS

This application claims the benefit of U.S. Provisional Application No. 61/788,203, filed on Mar. 15, 2013. The entire disclosure of the above application is hereby incorporated herein by reference.

FIELD

The present disclosure relates to memorial markers and, more particularly, to portable hollow tombstones.

BACKGROUND

Following the death of a loved one or pet, many people like to honor or remember the deceased with a memorial. A common method is to mark a burial site with a tombstone, also known as a memorial marker, a grave marker, or a headstone, where loved ones can visit for remembrance.

Cemetery burial plots are typically permanent. If one moves away a great distance from a cemetery, it becomes difficult to regularly visit the burial site. Cemetery plots also require fees and upkeep, and have become increasingly expensive as land used for this purpose becomes more valuable. While it used to be common to maintain burial sites and tombstones on a home property, modern government regulations commonly restrict this practice, particularly because burial sites can become an encumbrance on property transfer or development.

Another drawback to the traditional burial is that tombstones are commonly formed of a stone material such as granite, which makes them heavy, time consuming to engrave, and costly to transport. Typically, these heavy tombstones are purchased locally as blanks, and then engraved with custom designs and inscriptions. It is impractical to ship or buy from a remote location due to the extreme weight and need for expensive dunnage to prevent damage during transport.

Conventional tombstones also can often take substantial periods of time to produce and install, as engraving often takes weeks or months to complete. Also, because of the substantial weight, many tombstones require a concrete foundation be poured before they can be placed at a memorial site. If a burial occurs in a cold or wet climate, several months may pass after the burial before the ground is suitable for pouring the concrete foundation, further delaying the installation of the tombstone.

A common alternative to burial is cremation, where the ashes of the deceased are stored in an urn. Although urns can also be costly, an urn can be stored in a home, is easily moved, and may be passed down to future generations. Typically, urns are small or compact and, even though they may be formed from marble and other heavy materials, they can still be easily shipped. However, while urns do have the benefit of mobility, they do not provide a family with the pride and prestige of a normal tombstone.

There is a continuing need for an apparatus that provides a prestigious memorial site for the deceased. Desirably, the apparatus is portable and allows for the easy transportation of the apparatus to different locations.

SUMMARY

In concordance with the instant disclosure, an apparatus that provides a prestigious memorial site for deceased loved ones, and which is portable and allows for the easy transportation of the remains of the apparatus to different locations, has been surprisingly discovered.

In one embodiment, a portable tombstone includes a hollow main body having an upper portion and a base. The hollow main body has a first cavity and a second cavity. The first cavity is defined by an interior surface of the main body. The second cavity is defined by an exterior surface of the main body.

In another embodiment, the hollow main body further has an aperture in communication with the first cavity, and an orifice in communication with the second cavity. A plug selectively seals the aperture of the first cavity. A capsule is disposed within the second cavity, and has an opening adjacent the orifice of the second cavity. A cap selectively seals at least one of the orifice of the second cavity and the opening of the capsule.

In a further embodiment, the capsule is metal and is molded within the polymeric material of the main body during production of the portable tombstone. The metal capsule is also at least partly disposed in the first cavity. The main body itself has a stone-like appearance.

In an exemplary embodiment, a portable tombstone has a main body formed from rotationally- or blow-molded plastic. The main body is hollow, and has a removable plug in the bottom. The portable tombstone also has metal part inserts, such as engraved markers that are used to customize the portable tombstone to the individual. The engraved markers can be affixed to the main body with conventional fasteners such as bolts and screws. A metal bottle with a locking lid can also be molded into the main body, for use as an urn for ashes, or as a time capsule for mementos. The plastic used to form the main body may have additives to provide the appearance of real stone, such as sandstone, granite, limestone, and the like. There are also antidegradants added to the plastic to protect against UV and the elements, and to improve impact resistance.

In operation, the portable tombstone is shipped empty, in order to minimize shipping weight, and then filled with weighting material such as sand, dirt, glass, concrete, etc. when installed.

Advantageously, the weighting material may be removed so the tombstone can be easily relocated, as desired. The portable tombstone with the loved ones remnants and mementos can be placed in a back yard or cemetery to make a lovely shrine without making the backyard hallowed grounds or violating government regulations. The first cavity may include a removable plug in the bottom, so that the hollow tombstone can be shipped empty, in a box, and then filled with sand, dirt, glass, to make it heavy and weighting down. In addition, if filled with sand and the like, it can later be drained and easily transported if a person moves or a house is sold. For permanent usage, the portable tombstone can also be filled with concrete and the plug can be permanently installed, for example, with an adhesive or other sealing material.

Cast and painted house signs, name signs, and the like also exist today and can be made to be a faceplate marker for use on the tombstone. They are inexpensive to manufacture and can be applied with bolts or screws. In addition, markers for military service and vase-like flower holders can be attached or molded into the tombstone.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
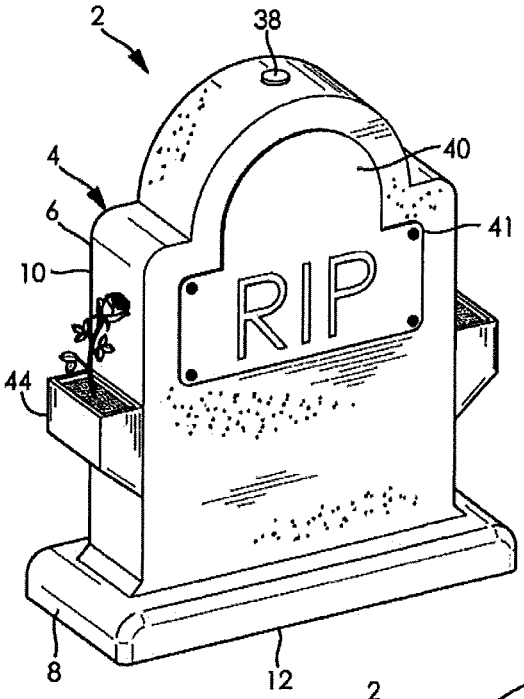
FIG. 1 is a front perspective view of a portable tombstone according to one embodiment of the disclosure.
Figure 2:
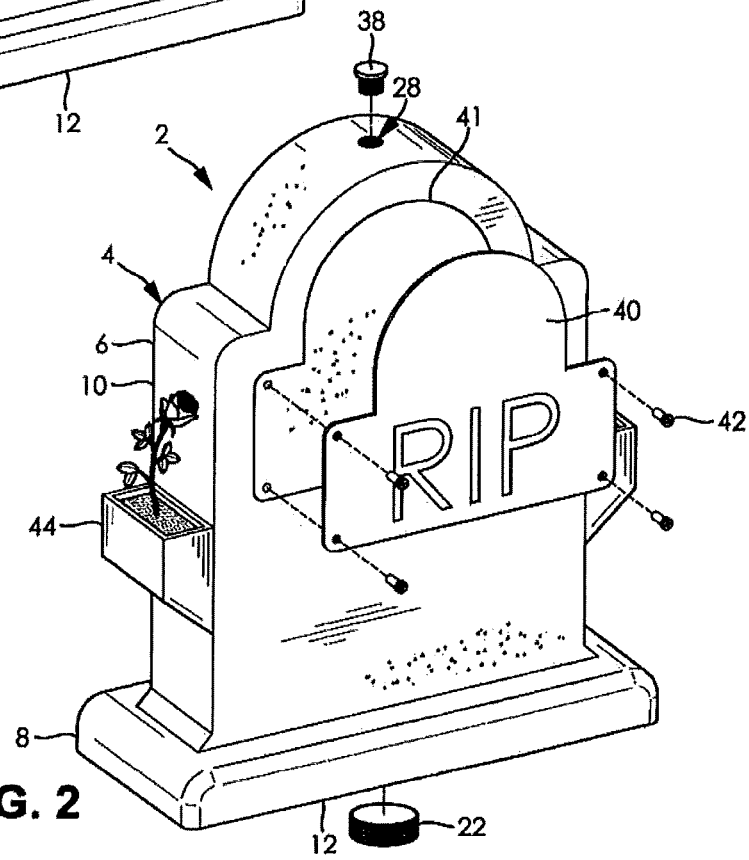
FIG. 2 is an exploded front perspective view of the portable tombstone shown in FIG. 1.
Figure 3:
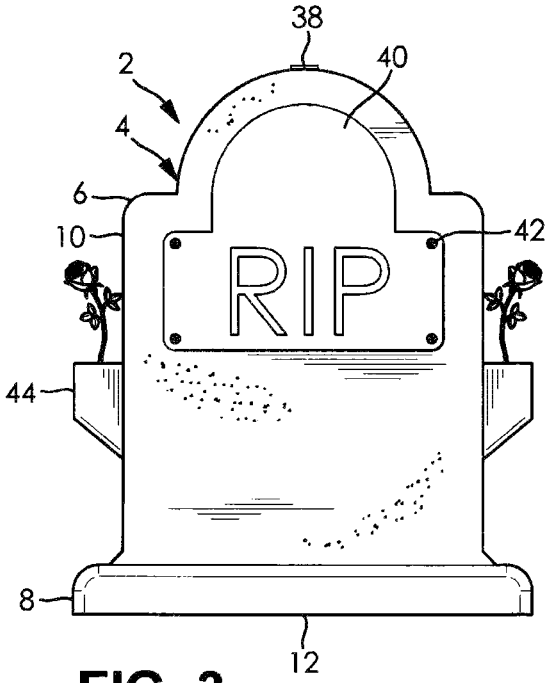
FIG. 3 is a front elevational view of the portable tombstone shown in FIG. 1.
Figure 4:
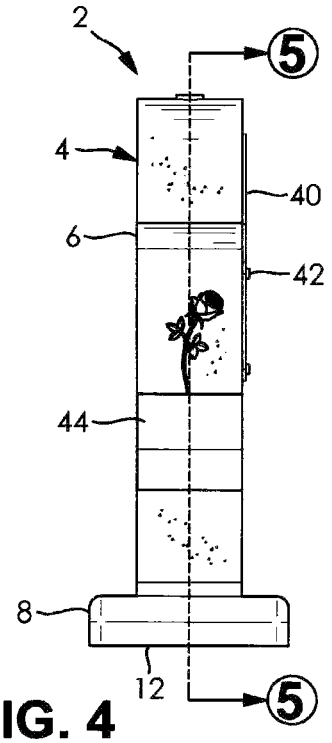
FIG. 4 is a side elevational view of the portable tombstone shown in FIG. 1.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

FIGS. 1-5 illustrate a portable tombstone 2 according to an embodiment of the instant disclosure. The tombstone 2 has a main body 4 with an upper portion 6 and a lower portion or base 8, which together define a hollow shell 10. The base 8 is formed on a lower portion of the hollow shell 10, and is configured to rest on a ground surface. The base 8 may have a width and length larger than that of the upper portion 6, in order to provide a stable foundation for the tombstone 2. However, it should be appreciated that the upper portion 6 and the base 8 may be of similar size and shape, as desired.

Optionally, stakes (not shown) may be attached to a bottom surface 12 of the base 8, for insertion into the ground surface. The stakes are configured to provide additional stability to the tombstone 2 in operation.

In certain embodiments, the main body 4 is formed from a polymeric material. The main body 4 may be formed by rotationally molding or blow molding the polymeric material, as nonlimiting examples. In one embodiment, the polymeric material is a polyethylene compound. In another embodiment, the polymeric material is an acrylic polymer such as AcrylaStone®, commercially available from AcrylaStone LLC in Wellington, Colo. One of ordinary skill in the art understands that other suitable types of polymeric materials may also be used within the scope of the present disclosure.

The polymer material forming the main body 4 may include stone-derived additives that give the polymeric material an appearance of being real stone, for example, sandstone, granite, limestone, or the like. Other additives may also be added to the polymeric material. The other additives may include anti-weathering additives such as antidegradants to enhance protection from ultraviolet exposure and improve weathering, for example. The other additives can also include reinforcing fillers such as fiberglass, carbon fiber, or Kevlar®, for example, to increase impact and scratch resistance. A skilled artisan may select suitable additives for the polymeric material, as desired.

While the main body 4 of the portable tombstone 2 is formed primarily of a polymeric material, it will be appreciated by one of ordinary skill in the art that other materials may also be used to form or reinforce the hollow shell 10. For example, metal inserts (not shown) may be disposed within or molded into the main body 4, to either further support the main body 4 or to receive attachable accessories of the portable tombstone 2. Other types of reinforcing inserts and attachment features may also be employed.

Figure 5:
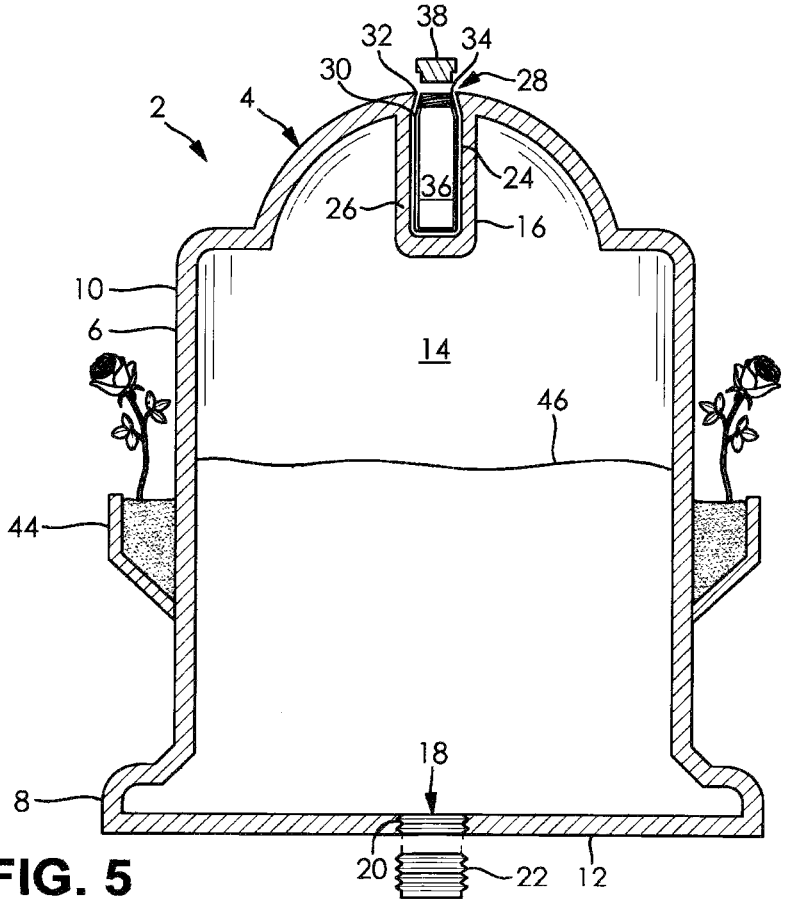
FIG. 5 is a cross-sectional front elevational view of the portable tombstone taken along section line 5-5 in FIG. 4.

As shown FIG. 5, the hollow shell 10 of the main body 4 has a first cavity 14. An interior surface 16 of the hollow shell 10 defines the first cavity 14. An aperture 18 may be formed in the bottom surface 12 of the base 8, and is in communication with the first cavity 14. The aperture 18 permits the filling of the first cavity 14 to increase a weight of the portable tombstone 2, as described further herein. Although shown in FIG. 5 being formed in the bottom surface 12 of the base 8, it should be appreciated that the aperture 18 may be formed in other surfaces of the main body 4 that also permit the filling of the first cavity 14.

In one example, the aperture 18 has internal threads and is configured to receive a threaded plug 22. In another example, not shown, the plug 22 may have a frictional or interference fit with an inner sidewall 20 of the aperture 18. One of ordinary skill in the art may also select other means for sealing the first cavity 14 within the scope of the present disclosure.

The hollow shell 10 of the main body 4 also has a second cavity 24. The second cavity 24 is defined by an exterior surface 26 of the hollow shell 10. The second cavity 24 is recessed within the hollow shell 10, for example. An orifice 28 of the second cavity 24 provides a conduit into the second cavity 24. As illustrated in FIG. 5, the first cavity 14 and the second cavity 24 may share a common sidewall, and the second cavity 24 may be at least partly arranged within the first cavity 14.

Although the second cavity 24 of the instant disclosure is shown at the top of the tombstone 2, it should be understood that the second cavity 24 may be formed anywhere within the main body 4, as desired. For example, the second cavity 24 may be formed in the base 8, wherein the orifice 28 is adjacent the aperture 18, and is concealed when the tombstone 2 is stood upright.

In a particular embodiment of the instant disclosure, a capsule 30 such as a crematory urn for ashes, a time capsule for mementos, and the like, is disposed in the second cavity 24. The capsule 30 may be a sealable metal cylinder, as a nonlimiting example. Other suitable material types and shapes for the capsule 30 may also be used, as desired.

The hollow shell 10 of the main body 4 may be molded over the capsule 30 during the formation of the main body 4, for example. Although the capsule 30 is shown disposed in the upper portion 6 of the main body 4, it should be understood that the capsule 30 can be recessed in the base 8, for example, in the underside of the base 8, as desired. A lip 32 bounds the orifice 28 of the second cavity 24, and may reduce a size of the orifice 28 to less than a diameter of the capsule 30. In this manner, the lip 32 may retain the capsule 30 within the second cavity 24, and thereby militate against removal of the capsule 30 from the second cavity 24 in operation.

In yet another embodiment of the instant disclosure, not shown, a plurality of secondary cavities 24 may be formed in the hollow shell 10. Each of the secondary cavities 24 may be defined by the exterior surface 26 of the hollow shell 10. At least one of the plurality of secondary cavities 24 has the capsule 30 integrally formed therein. In this embodiment, each of the capsules 30 may be provided for a unique purpose. For example, a first capsule 30 may be an urn, and a second capsule 30 may be a time capsule. Alternatively, each of the plurality of secondary cavities 24 is dimensioned to hold the contents directly, and without one of the capsules 30.

With renewed reference to FIG. 5, it should be understood that an opening 34 of the capsule 30 may be positioned adjacent the orifice 28. The opening 34 provides access to an interior chamber 36 of the capsule 30. The opening 34 may include one of interior and exterior threads for receiving corresponding threads of a sealing cap 38. Other suitable means of sealing the opening 34 of the capsule 30 with the sealing cap 38 may also be employed, as desired.

Where the second cavity 24 is configured to hold desired contents without the capsule 30, the orifice 28 may likewise be configured to receive the sealing cap 38. For example, the orifice 28 may have internal threads for receiving external threads of the sealing cap 38. It should be understood by those of ordinary skill in the art that threads are but one non-limiting example of means for securing the plug 22 and sealing cap 38, and that other methods, such as crimping, adhesion, or frictional interference, may be used.

A placard 40 is attached to upper portion 6 of the main body 4. The placard 40 may include a decorative metal sheet with a memorial inscription noting the identity of the deceased loved one or pet, along with other images or messages one wishes to include on the tombstone 2, such as military service markings. The placard 40 may be received by a recessed area 41 of the main body 4, having a perimeter shape conforming to a perimeter shape of the placard 40, for example. The recessed area 41 may facilitate a securing of the placard 40 to the main body 4. Suitable shapes and materials for the placard may be employed by a skilled artisan, as desired.

In the illustrated embodiment, the placard 40 is removably attached to the main body 4 using a plurality of fasteners 42, such as screws or bolts. However, it should be understood that the placard 40 may be removably or permanently attached by any one of a variety of fastening means, including hook and loop, magnetic attachment, adhesive strips, and adhesive bonding. Alternatively, the placard 40 may be molded into the hollow shell 10 during manufacturing.

Optionally, an at least one planter 44 may also be included on one of the upper portion 6 and the lower portion 8 of the tombstone 2. In one embodiment (not shown), the planter 44 is molded integrally with the main body 4. In another embodiment, as shown in FIG. 5, the planter 44 is formed separately from the main body 4, and is provided as an optional attachment feature for the tombstone 2.

Figure 6:
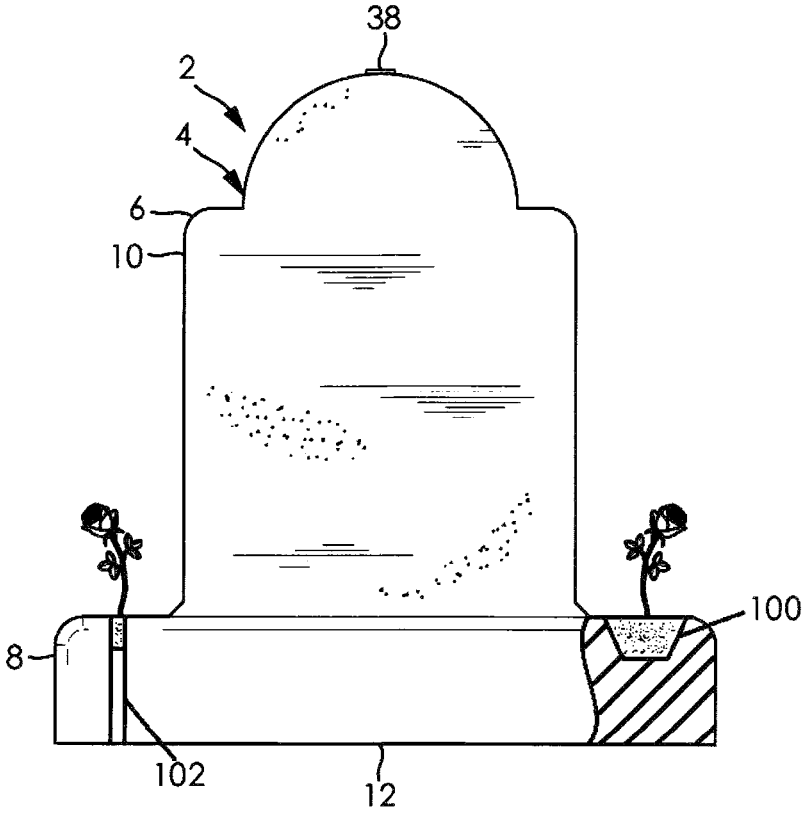
FIG. 6 is a rear elevational view of the portable tombstone according to another embodiment of the present disclosure, depicted with a section of the lower portion removed to show a planter recess and drainage channel.

In a further embodiment shown in FIG. 6, the tombstone 2 may have a planter recess 100 formed in the lower portion 8 for receiving a planter (not shown), or for directly receiving soil and a decorative plant. A flow channel 102 in communication with the planter recess 100 may further be formed in a rear surface of the lower portion 8. The flow channel 102 is configured to drain excess water from the planter recess 100, and militate against the formation of stagnant water that may be used as a breeding ground for mosquitoes, etc. The flow channel 102 may be angled downwardly from the planter recess 100, to further facilitate the removal of water. Suitable shapes for the planter recess 100 and the related flow channel 102 may be selected by the skilled artisan, as desired.

In operation, the tombstone 2 is delivered to the user having an empty first cavity 14. When the first cavity 14 is empty, the tombstone 2 is of minimal weight, allowing the tombstone 2 to be easily and inexpensively transported. Upon receiving the tombstone 2, the user places the tombstone 2 in a desired location for display, such as a back yard, memorial garden, or cemetery. The plug 22 is removed from the aperture 18, and a weighting media 46 is introduced into the first cavity 14 through the aperture 18. The plug 22 is then reinstalled within the aperture 18 to seal the first cavity 14, thereby preventing discharge of the weighting media 46 stored within the first cavity 14. With the first cavity 14 sealed, the tombstone 2 is stood upright and the weighting media 46 settles to the bottom of the tombstone 2, providing a low center of gravity and improving a stability of the tombstone 2.

Where the user desires to transport or move the tombstone 2, the process described hereinabove is reversed to discharge the weighting media 46 from the first cavity 14.

It should be understood that the weighting media 46 can substantially conform to the shape of the first cavity 14. For example, the weighting media may be a granular or fluid material. As particular nonlimiting examples, the weighting media 46 may be one of a sand, rock, gravel, water, or a mixture thereof. Where a user desires the tombstone 2 to be permanent, the first cavity 14 may be filled with cement. Other suitable materials for the weighting media 46 may also be employed, as desired.

As described hereinabove, the second cavity 24 including the capsule 30 and the sealing cap 38 is separate from the first cavity 14, and does not receive the weighting media 46. The sealing cap 38 may be removed from the opening 34 of the capsule 30 to expose the interior chamber 36 of the capsule 30. The user may then add contents to the interior chamber 36. Where the capsule 30 is an urn, ashes of a loved one or pet may be placed in the interior chamber 36 of the capsule 30. Where the capsule 30 is a time capsule, mementos or pictures may be stored in the interior chamber 36. The sealing cap 38 is then reinstalled over the opening 34 of the capsule 30, sealingly enclosing the interior chamber 36 to preserve the added contents.

Alternatively, the second cavity 24 may not include the capsule 30, and the contents are stored directly in the second cavity 24. In such cases, the sealing cap 38 is installed in the orifice 28 of the second cavity 24. The sealing cap 38 may also be lockable, so as to permanently install the contents within the second cavity 24 of the tombstone 2.

The placard 40 may further be inscribed with a memorial message and attached to the tombstone 2 using the fasteners 42. The placard 40 may be removably attached by the user, allowing multiple placards 40 with various inscriptions to be interchanged as desired. The placard 40 may also be permanently attached to the tombstone 2, in order to prevent theft or vandalism.

Advantageously, the tombstone 2 of the present disclosure provides a prestigious memorial site for the deceased. The tombstone 2 is surprisingly portable and allows for the easy transportation of the remains of the deceased to different locations.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A portable tombstone, comprising:

a hollow main body having a first cavity and a second cavity, the first cavity defined by an interior surface of the main body, and the second cavity defined by an interior surface of a capsule-receiving body, the capsule-receiving body depending from the interior surface of the main body, the capsule-receiving body also extending into the first cavity and having a closed free end disposed inside of the first cavity and spaced apart from the interior surface of the main body, the hollow main body further having an aperture in communication with the first cavity and an orifice in communication with the second cavity;

a plug for selectively sealing the aperture of the first cavity;

a capsule disposed within the second cavity, the capsule having an opening adjacent the orifice of the second cavity; and a cap for selectively sealing at least one of the orifice of the second cavity and the opening of the capsule.

2. The portable tombstone of claim 1, further comprising a removable placard.

3. The portable tombstone of claim 2, wherein the exterior surface of an main body has a recess for receiving the removable placard.

4. The portable tombstone of claim 1, further comprising at least one planter.

5. The portable tombstone of claim 1, wherein a base of the main body has a flow channel for drainage of excess water from a planter recess formed in the base.

6. The portable tombstone of claim 1, wherein the first cavity contains a weighting media.

7. The portable tombstone of claim 1, wherein the main body is formed by one of blow molding and rotationally molding a polymeric material.

8. The portable tombstone of claim 7, wherein the polymeric material includes one of a polyethylene and an acrylic polymer.

9. The portable tombstone of claim 7, wherein the polymeric material has a stone appearance.

10. The portable tombstone of claim 9, wherein the polymeric material includes a stone additive to provide the stone appearance.

11. The portable tombstone of claim 7, wherein the polymeric material includes an anti-weathering additive to militate against at least one of ultraviolet degradation and weathering.

12. The portable tombstone of claim 7, wherein the polymeric material includes a reinforcing additive.

13. The portable tombstone of claim 1, wherein the capsule is molded into the main body and is arranged at least partly in the first cavity of the main body.

14. The portable tombstone of claim 1, wherein the interior surface of the capsule-receiving body includes a portion of an exterior surface of the main body.

15. A portable tombstone, comprising:

a hollow main body having a first cavity and a second cavity, the first cavity defined by an interior surface of the main body, and the second cavity defined by an interior surface of a capsule-receiving body, the capsule-receivinq body depending from the interior surface of the main body, the capsule-receiving body also extending into the first cavity and having a closed free end disposed inside of the first cavity and spaced apart from the interior surface of the main body, wherein the interior surface of the capsule-receiving body includes a portion of an exterior surface of the main body, the hollow main body further having an aperture in communication with the first cavity and an orifice in communication with the second cavity, the main body molded from a polymeric material having a stone appearance;

a placard received in a recess on the exterior surface of the main body, and removably connected to the main body with at least one fastener;

a plug for selectively sealing the aperture of the first cavity;

a metal capsule molded in the polymeric material of the main body and disposed within the second cavity, the metal capsule at least partly disposed in the first cavity, the capsule having an opening adjacent the orifice of the second cavity; and a cap for selectively sealing the opening of the capsule.

* * * * *